US007537296B2

(12) United States Patent
Leon et al.

(10) Patent No.: US 7,537,296 B2
(45) Date of Patent: May 26, 2009

(54) DAMPENED MOVEMENT MECHANISM AND SLIDE INCORPORATING THE SAME

(75) Inventors: Ricardo A. Leon, Buena Park, CA (US); Baoloc T. Le, La Puente, CA (US); Emmanuel A. Hanna, Lake View Terrace, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 11/266,870

(22) Filed: Nov. 3, 2005

(65) Prior Publication Data

US 2006/0113169 A1 Jun. 1, 2006

Related U.S. Application Data

(60) Provisional application No. 60/625,475, filed on Nov. 5, 2004.

(51) Int. Cl.
*A47B 88/00* (2006.01)

(52) U.S. Cl. ..... 312/333

(58) Field of Classification Search ..... 312/333, 312/334.44–334.47, 334.6, 319.1; 384/21
See application file for complete search history.

(56) References Cited

U.S. PATENT DOCUMENTS

| | | | |
|---|---|---|---|
| 930,534 | A | 8/1909 | Cox |
| 3,104,142 | A | 9/1963 | Knape et al. |
| 3,139,313 | A | 6/1964 | Rule |
| 3,243,247 | A | 3/1966 | Knape |
| 3,506,292 | A | 4/1970 | Hagendoorn et al. |
| 3,574,437 | A | 4/1971 | Stein et al. |
| 3,666,342 | A | 5/1972 | Biesecker |
| 3,697,140 | A | 10/1972 | Livingston |
| 3,700,301 | A | 10/1972 | Boeck |
| 3,713,681 | A | 1/1973 | Worley |
| 3,716,279 | A | 2/1973 | Anderson et al. |
| 3,954,315 | A | 5/1976 | Sanden |
| 3,973,814 | A | 8/1976 | Entrikin |
| 4,006,951 | A | 2/1977 | Geer et al. |
| 4,116,512 | A | 9/1978 | Wiser |

(Continued)

FOREIGN PATENT DOCUMENTS

DE 41 24512 A1 2/1992

(Continued)

OTHER PUBLICATIONS

FR 5000 Full-Extension Ballbearing Drawerslide, Fulterer, p. 39.

(Continued)

*Primary Examiner*—Janet M Wilkens
(74) *Attorney, Agent, or Firm*—Christie, Parker & Hale, LLP

(57) ABSTRACT

Self-moving mechanisms, slides incorporating such mechanisms, i.e., self-moving slides and methods of self-moving slides are provided. An exemplary embodiment self-moving slide includes a first slide member and a second slide member slideably coupled to the first slide member. A self-moving mechanism is coupled to the second slide member for self-moving the first slide member relative to the second slide member. A dampener is included dampening the movement of the first slide member relative to the second slide member.

30 Claims, 14 Drawing Sheets

U.S. PATENT DOCUMENTS

| | | | | |
|---|---|---|---|---|
| 4,138,174 | A | 2/1979 | Cox et al. | |
| 4,155,610 | A | 5/1979 | Englund | |
| 4,159,153 | A | 6/1979 | Yoshikawa | |
| 4,423,914 | A | 1/1984 | Vander Ley | |
| 4,494,806 | A | 1/1985 | Williams et al. | |
| 4,501,455 | A | 2/1985 | Groseck | |
| 4,600,255 | A | 7/1986 | Dubarko | |
| 4,615,095 | A | 10/1986 | Bessinger et al. | |
| 4,653,820 | A | 3/1987 | Tazaki | |
| 4,679,950 | A | 7/1987 | Delmege et al. | |
| 4,811,579 | A | 3/1989 | Lyons et al. | |
| 4,872,734 | A | 10/1989 | Rechberg | |
| 5,015,048 | A | 5/1991 | Brunnert | |
| 5,020,868 | A | 6/1991 | Brunnert | |
| 5,033,805 | A | 7/1991 | Hobbs | |
| 5,040,833 | A | 8/1991 | Brunnert | |
| 5,040,858 | A | 8/1991 | Kruse et al. | |
| 5,056,879 | A | 10/1991 | Röck et al. | |
| 5,207,781 | A | 5/1993 | Röck | |
| 5,226,716 | A | 7/1993 | Geil | |
| 5,232,278 | A | 8/1993 | O'Brien et al. | |
| 5,240,318 | A | 8/1993 | Schröder et al. | |
| 5,255,983 | A | 10/1993 | Parvin | |
| 5,302,016 | A | 4/1994 | Lautenschläger et al. | |
| 5,312,180 | A | 5/1994 | Tieder et al. | |
| 5,364,179 | A | 11/1994 | Brüstle et al. | |
| 5,388,902 | A | 2/1995 | Huebschen et al. | |
| 5,421,481 | A | 6/1995 | Fortmann et al. | |
| 5,433,517 | A | 7/1995 | Fleisch | |
| 5,474,375 | A | 12/1995 | Hollenstein et al. | |
| 5,484,209 | A | 1/1996 | Weng | |
| 5,520,452 | A | 5/1996 | Petersen et al. | |
| 5,542,759 | A | 8/1996 | Krivec | |
| 5,580,138 | A | 12/1996 | Grabher | |
| 5,671,988 | A | 9/1997 | O'Neill | |
| 5,671,989 | A | 9/1997 | Lautenschläger | |
| 5,681,066 | A | 10/1997 | Anderson | |
| 5,730,514 | A | 3/1998 | Hashemi | |
| 5,733,027 | A | 3/1998 | Lautenschläger | |
| 5,909,935 | A | 6/1999 | Esperandieu et al. | |
| 5,944,396 | A | 8/1999 | Stephan | |
| 5,961,193 | A | 10/1999 | Hobbs | |
| 5,975,662 | A | 11/1999 | Weber | |
| 6,254,205 | B1 | 7/2001 | Wright et al. | |
| 6,340,078 | B1 | 1/2002 | Scheible | |
| 6,412,891 | B1 | 7/2002 | Liang et al. | |
| 6,629,738 | B2 * | 10/2003 | Salice | 312/333 |
| 6,666,306 | B2 | 12/2003 | Gasser | |
| 6,712,435 | B2 | 3/2004 | Kim et al. | |
| 6,733,097 | B2 | 5/2004 | Kim et al. | |
| 6,736,471 | B2 * | 5/2004 | Lin | 312/333 |
| 6,752,478 | B1 | 6/2004 | Francz | |
| 6,846,053 | B2 * | 1/2005 | Salice | 312/334.14 |
| 6,953,233 | B2 | 10/2005 | Lam et al. | |
| 6,971,729 | B1 | 12/2005 | Kim et al. | |
| 6,979,066 | B2 * | 12/2005 | Yang | 312/333 |
| 7,028,370 | B2 * | 4/2006 | Hoshide et al. | 16/96 R |
| 7,249,813 | B2 * | 7/2007 | Gasser | 312/333 |
| 7,399,041 | B2 * | 7/2008 | Prentner et al. | 312/333 |
| 2002/0011766 | A1 | 1/2002 | Kim et al. | |
| 2002/0033658 | A1 | 3/2002 | Salice | |
| 2003/0067257 | A1 | 4/2003 | Gasser | |
| 2003/0075845 | A1 | 4/2003 | Krammer | |
| 2004/0000850 | A1 | 1/2004 | Lam Harn et al. | |
| 2004/0107536 | A1 * | 6/2004 | Hollenstein | 16/94 R |
| 2007/0132346 | A1 * | 6/2007 | Huang | 312/333 |

FOREIGN PATENT DOCUMENTS

| | | | |
|---|---|---|---|
| EP | 0 386 731 | B1 | 9/1990 |
| EP | 0 391 221 | A1 | 10/1990 |
| EP | 0 529 679 | B1 | 3/1993 |
| EP | 0 552 500 | A1 | 7/1993 |
| JP | 405317133 | A | 12/1993 |

OTHER PUBLICATIONS

Selby On-Line Furniture Brochure, "Drawer Slides", Selby Furniture Hardware Co., Inc. —The Houdini of Hardware, May 2, 2003, 3 pages.

* cited by examiner

DAMPENED MOVEMENT MECHANISM AND SLIDE INCORPORATING THE SAME

CROSS-REFERENCE TO RELATED APPLICATION

This application is based upon and claims priority on U.S. Provisional Application No. 60/625,475, filed on Nov. 5, 2004, the contents of which are fully incorporated herein by reference.

BACKGROUND OF THE INVENTION

The present invention is directed to self-moving slides, self-moving mechanisms for slides, and to methods for self-moving slides. Drawers or other movable components are typically coupled to cabinets or other stationary components using slides. These slides are typically two-member slides or three-member slides. A two-member slide includes a stationary member and a telescoping member. The telescoping member is slidably coupled to the stationary member and can telescope relative to the stationary member. A three-member slide includes three members, namely, a stationary member, an intermediate member, and a telescoping member. The intermediate member is slidably coupled to the stationary member and the telescoping member is slidably coupled to the intermediate member. Both the intermediate and telescoping members telescope relative to the stationary member. Moreover, the telescoping member can telescope relative to the intermediate member. Typically the slide's stationary member is coupled to the cabinet and the telescoping member is coupled to a side of the drawer.

The problem with many drawers is that they tend to open after they are closed. Another problem with drawers is that when they are pushed to close, they sometimes do not close completely because they are not pushed with sufficient force or alternatively they are pushed with more force than necessary causing the drawers to slam against the cabinet and re-open. Another problem is that the drawers do not open easily. Sometimes, self-moving mechanisms are incorporated in such slides to help self-move one slide member relative to the other to a closed or an open position. However, such mechanisms may cause a telescoping slide member to move abruptly relative to a stationary slide member, thus causing the drawer or other movable component to move abruptly.

Consequently, a mechanism is desired for use in slides that will keep the slides in a closed position when the slides are fully closed and that will also help the slides self-close as they reach close to the end of their rearward travel. Similarly, a mechanism is also desired for use in slides that will help self-open such slides. Moreover, a mechanism is desired that will dampen such self-opening or self-closing movement.

SUMMARY OF THE INVENTION

Dampened movement mechanisms, slides incorporating the same and methods of self-moving a slide are provided. An exemplary dampened movement mechanism has a housing and a slider sliding along the housing. A spring is coupled to the slider and to the housing so as to exert a force on the slider. A pivoting member is pivotally coupled to the slider. A link rides on an upper surface of the slider and exerts a force against a dampening member. As the slider slides along a first direction with the spring force, the link is moved so as to exert the force against the dampener. As a result, the movement of the slider and thus the pivoting member is dampened. When the slider with pivoting member is slid in an opposite direction, the spring is energized. When the pivoting member reaches an end of its travel it pivots and remains armed at a set position relative to the housing. In an exemplary embodiment, the dampened movement mechanism is coupled to a slide stationary member and the pivoting member is engaged by a setter coupled to an extendible member (i.e., a telescoping member) of the slide which is slideably coupled to the stationary member of the slide.

In an exemplary embodiment a self-moving slide is provided having a first slide member and a second slide member slideably coupled to the first slide member where the first slide member slides relative to the second slide member. A self-moving mechanism is coupled to the second slide member. The self-moving mechanism includes a housing, a slider sliding along the housing, and an actuator pivotably coupled to the slider and sliding along the housing. The actuator couples with the first slide member for moving the first slide member. The self-moving mechanism also includes a dampener dampening the movement of the slider. In a further exemplary embodiment, a spring is coupled to the slider and the housing. In another exemplary embodiment, the slider and actuator slide together along the housing between a first location and a second location. In yet another exemplary embodiment, the spring exerts a force for moving the slider to the first location. In a further exemplary embodiment, when in the first location, the actuator is in a first position and when in the second location, the actuator can pivot to a second position.

In another exemplary embodiment, the dampener dampens the movement of the slider only when the slider is moving toward the first location. In a further exemplary embodiment a link couples the dampener to the slider. In yet another exemplary embodiment, the slider includes a inclining surface. The link rides on the inclining surface as the slider slides toward the first location exerting a force against the dampener. In an exemplary embodiment, the dampener includes a piston sliding within a body against a dampening force, and an arm extending from the piston, where the link exerts a force against the arm moving the arm against the dampening force.

In yet another exemplary embodiment, the self-moving slide further includes a setter extending from the first slide member. The actuator includes a slot for receiving the setter for coupling the first slide member to the actuator. The setter, in one exemplary embodiment, is separate from the first slide member and is coupled to the first slide member. In another exemplary embodiment, the setter is integral with the first slide member.

In another exemplary embodiment, the actuator includes a pivoting member and a reload arm coupled to the pivoting member. The pivoting member is pivotably coupled to the slider pivotably coupling the slider to the actuator. In yet a further exemplary embodiment, the actuator has a first edge opposite a second edge defining a slot there-between. The first edge is formed on the reload arm and the second edge is formed on the pivoting member.

In an exemplary embodiment, as the first slide member extends relative to the second slide member, the setter causes the slider to move to the second location and the actuator to pivot to the second position. When the actuator is in the second position, the setter decouples from the actuator as the first slide member is further extended. In another exemplary embodiment, when the actuator is in the second position it is urged against a portion of the housing by the spring force. With this embodiment, the actuator is retained in the second position by the portion of the housing.

In yet another exemplary embodiment, when retracting the first slide member relative to the second slide member, the setter couples with the actuator which is in the second position and causes the actuator to pivot to the first position. When the actuator is in the first position, the spring force causes the actuator with the slider to slide to the first location thereby causing the setter and first slide member to slide to the first position.

In yet a further exemplary embodiment, the housing includes a first groove and a second groove. The second groove has a first portion and a second portion extending transversely from the first portion. The slider includes a projection guiding the slider along the first groove. The actuator also includes a projection guiding the actuator along the second groove. When the actuator is in the second position, the actuator projection is in the second portion of the second groove and it is urged against the second portion of the second groove by the spring force. When in the second position, the actuator is retained by the spring force against the second portion of the second groove. In another exemplary embodiment, the reload arm is pushed by the setter and flexes when the slider is in the second location and the first slide member is retracted relative to the second slide member to allow setter to be received in the actuator slot.

In a further exemplary embodiment, the housing includes a first portion opposite a second portion. The first and second grooves, as discussed above, are formed on the first housing portion. A third groove is formed on the second housing portion and a fourth groove is formed on the second housing portion. The fourth groove has a first portion and a second portion extending transversely from the fourth groove first portion. The third groove mirrors the first groove and the fourth groove mirrors the second groove. The slider includes a second projection guiding the actuator along the third groove. The reload arm includes a projection guiding the actuator along the fourth groove.

In yet another exemplary embodiment, the actuator includes a portion that compresses when pushed by the setter when the slider is in the second location and the first slide member is retracted relative to the second slide member to allow setter to be received in the actuator slot. The actuator portion in one exemplary embodiment is a reload arm which is coupled to a pivoting member of the actuator and which flexes to compress.

DETAILED DESCRIPTION OF THE INVENTION

The present invention is directed to dampened movement mechanisms, to slides incorporating the same, and to methods of self-moving a slide. A dampened movement mechanism is mounted on a slide, as for example a drawer slide, for self-moving the slide toward an opened (e.g., extended) or a closed (e.g., retracted) position, as well as dampening the movement of the slide. For illustrative purposes, various exemplary embodiments of inventive dampened movement mechanisms are described in relation to an under-mount drawer slide where the mechanism is mounted to act as a self-closing mechanism which causes the slide to close when reaching a specific location along the slide travel and which dampens or softens the self-closing motion. However, the mechanism can be mounted to act as a self-opening mechanism. Moreover, the mechanism may be used with other types of slides which may be used with drawers as well as other moveable furniture components. A self-moving slide is a slide incorporating any of the exemplary embodiment self-moving mechanisms.

Figure 1:
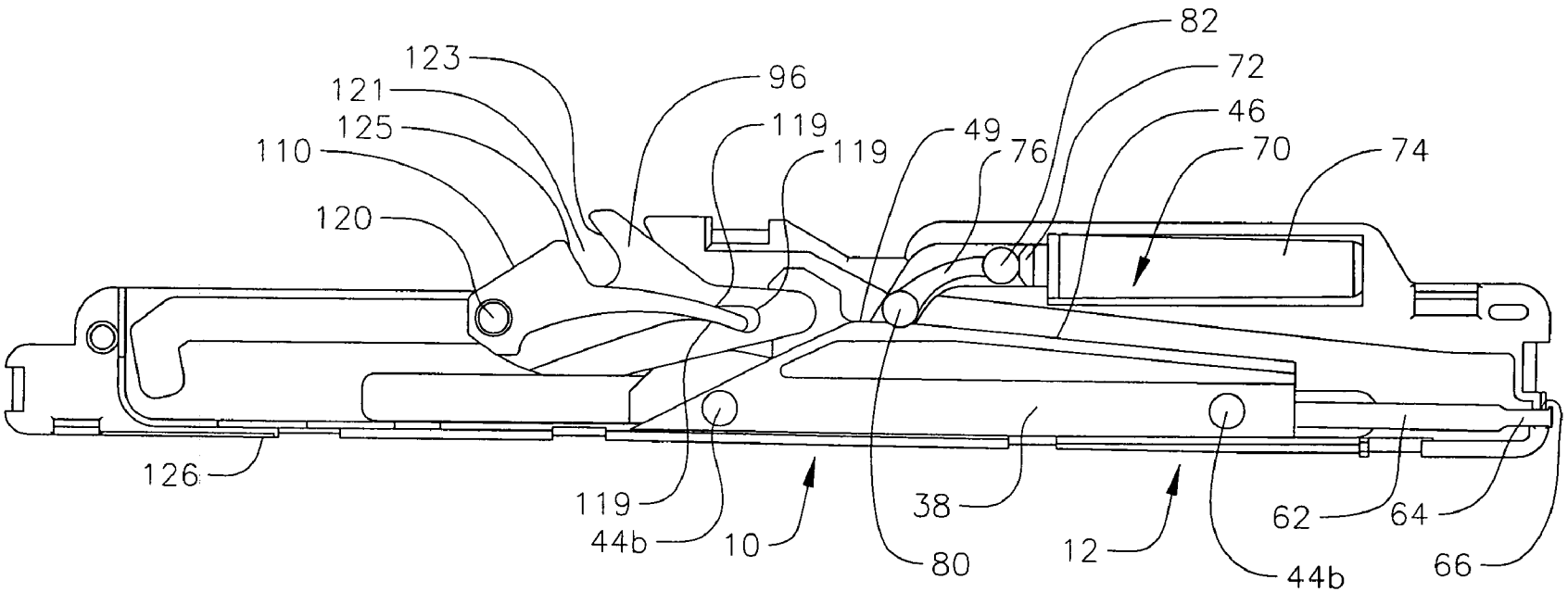
FIG. 1 is a top view of an exemplary embodiment dampened movement mechanism of the present invention with a housing portion removed.
Figure 2A:
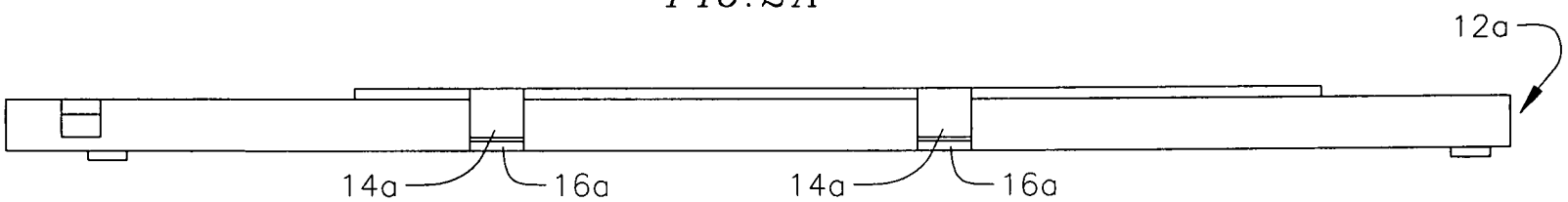
FIGS. 2A and 2B are bottom and side views of an exemplary embodiment dampened movement mechanism housing portion.
Figure 2B:
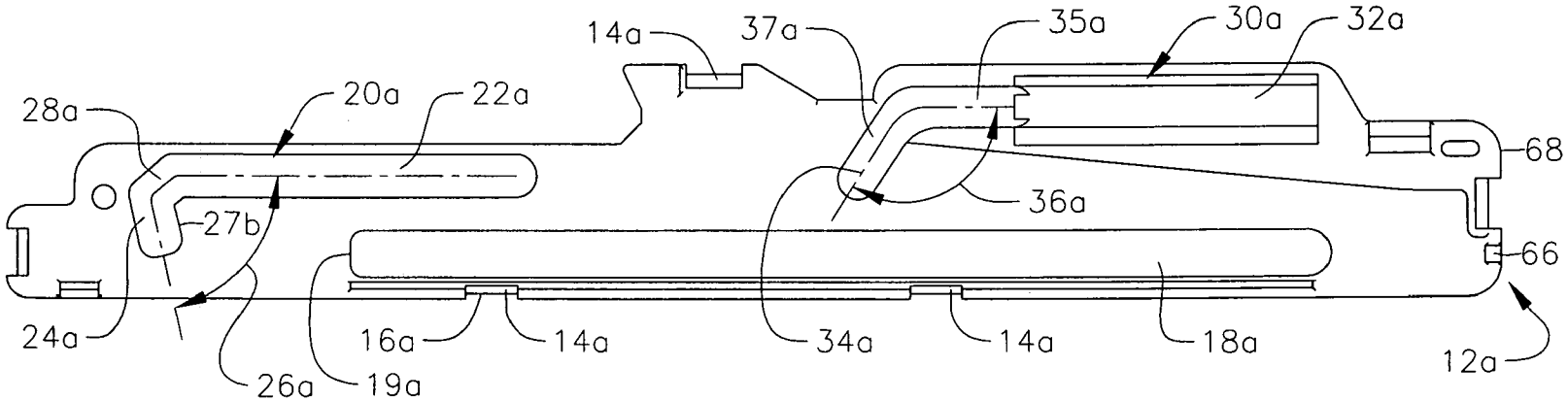
Figure 2C:
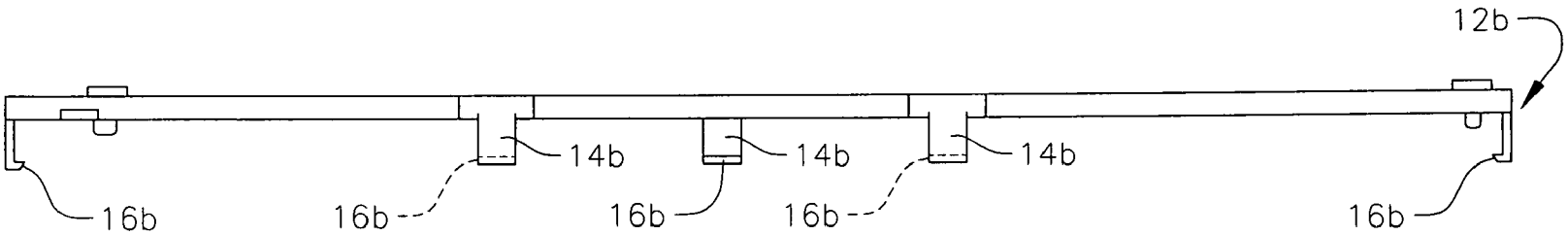
FIGS. 2C and 2D are bottom and side views of another housing portion of an exemplary embodiment dampened movement mechanism of the present invention which housing portion when coupled with the housing portion shown in FIGS. 2A and 2B forms a housing of an exemplary dampened movement mechanism of the present invention.
Figure 2D:
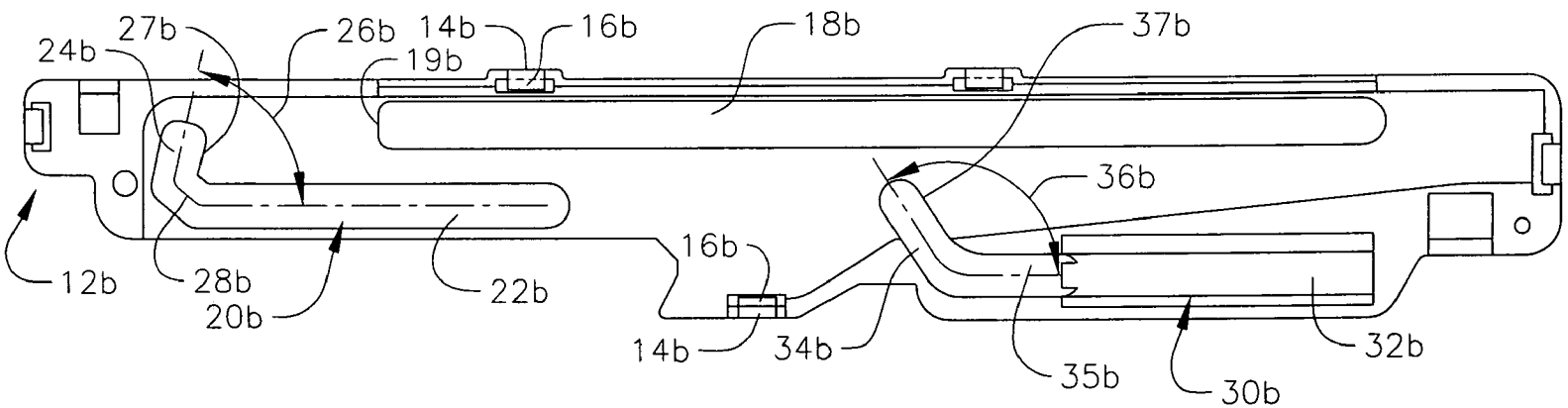

An exemplary dampened movement mechanism 10 of the present invention is shown in FIG. 1. The exemplary embodiment mechanism has a housing 12. In the exemplary embodiment, the housing is formed in two separate portions 12*a* (FIGS. 2A and 2B) and 12*b* (FIGS. 2C and 2D) which are then coupled to each other to form an enclosure. One housing portion 12*b* may include legs 14*b* extending from the housing which penetrate slots 14*a* formed on the other housing portion 12*a* (FIGS. 2A and 2B) when the two portions are coupled together. The legs 14*b* on housing portion 12*b* of the housing may include projections 16*b* which engage notches 16*a* in the slots 14*a* formed on the other housing portion 12*a* for locking the two housing portions together.

In an exemplary embodiment, the inner surface of each housing portion is formed with grooves for guiding the movement of various parts housed in the housing. Since these grooves replicate each other on each housing portion, the grooves with respect to one housing portion will only be described herein. These grooves are identified by a reference numeral followed by the letter "a" when designating grooves formed on housing portion 12*a* and followed by the letter "b" when designating corresponding grooves formed on the other housing portion 12*b*.

In an exemplary embodiment, a slider groove 18*a*, 18*b* is formed on a lower portion of the housing portion 12*a*, 12*b* inner surface and extends longitudinally across the housing. It should be understood that the terms "upper," "lower," "over," "below," "front," "back," "forward," "rearward," and "rear," are used to designate the relative locations between elements and not the exact locations of the elements. For example, a "lower" element may be located above an "upper" element under certain conditions, as for example when the part on which the elements are formed is turned upside down.

A pivoting member groove 20*a*, 20*b* is formed on the housing portion 12*a*, 12*b* inner surface spaced apart and above the slider groove 18*a*, 18*b* and extends along a forward portion of the slider groove and beyond a forward end 19*a*, 19*b* of the slider groove. The pivoting member groove has a first longitudinal portion 22*a*, 22*b* and a second transverse portion 24*a*, 24*b* which in the exemplary embodiment extends downward at an acute angle 26*a*, 26*b* less than 90° relative to the first longitudinal portion 22*a*, 22*b*. In an exemplary embodiment, the angle 26*a*, 26*b* can be any angle in the range from 60° to 90°. In the exemplary embodiment shown in FIGS. 2A and 2B, the angle 26*a*, 26*b* is about 77°. The pivoting member transverse groove has a rear edge 27*a*, 27*b*. The two pivoting member groove portions are interconnected with an intermediate portion 28*a*, 28*b*.

A dampener groove 30*a*, 30*b* is formed rearward on the housing portion 12*a*, 12*b* inner surface in relation to the pivoting member groove and above the slider groove and is spaced apart from both the pivoting member groove and the slider groove. The dampener groove includes a main portion 32*a*, 32*b* which in the shown exemplary embodiment is a longitudinal portion, and a link groove portion 34*a*, 34*b* which extends forward of the main portion. The main portion groove is wider than the link groove. The link groove has a first portion 35*a*, 35*b*, and a second portion 37*a*, 37*b* that extends downward at an angle 36*b* relative to the main portion. In an exemplary embodiment the angle 36*a*, 36*b* between the main portion and the link portion of the dampener groove is greater than 90° but less than 180°. In the shown exemplary embodiment, the angle 36*a*, 36*b* is about 125°. The first portion of the link groove extends longitudinally from the main portion of the dampener groove.

Figures 3A, 3B, 3C, 3D, 3E:
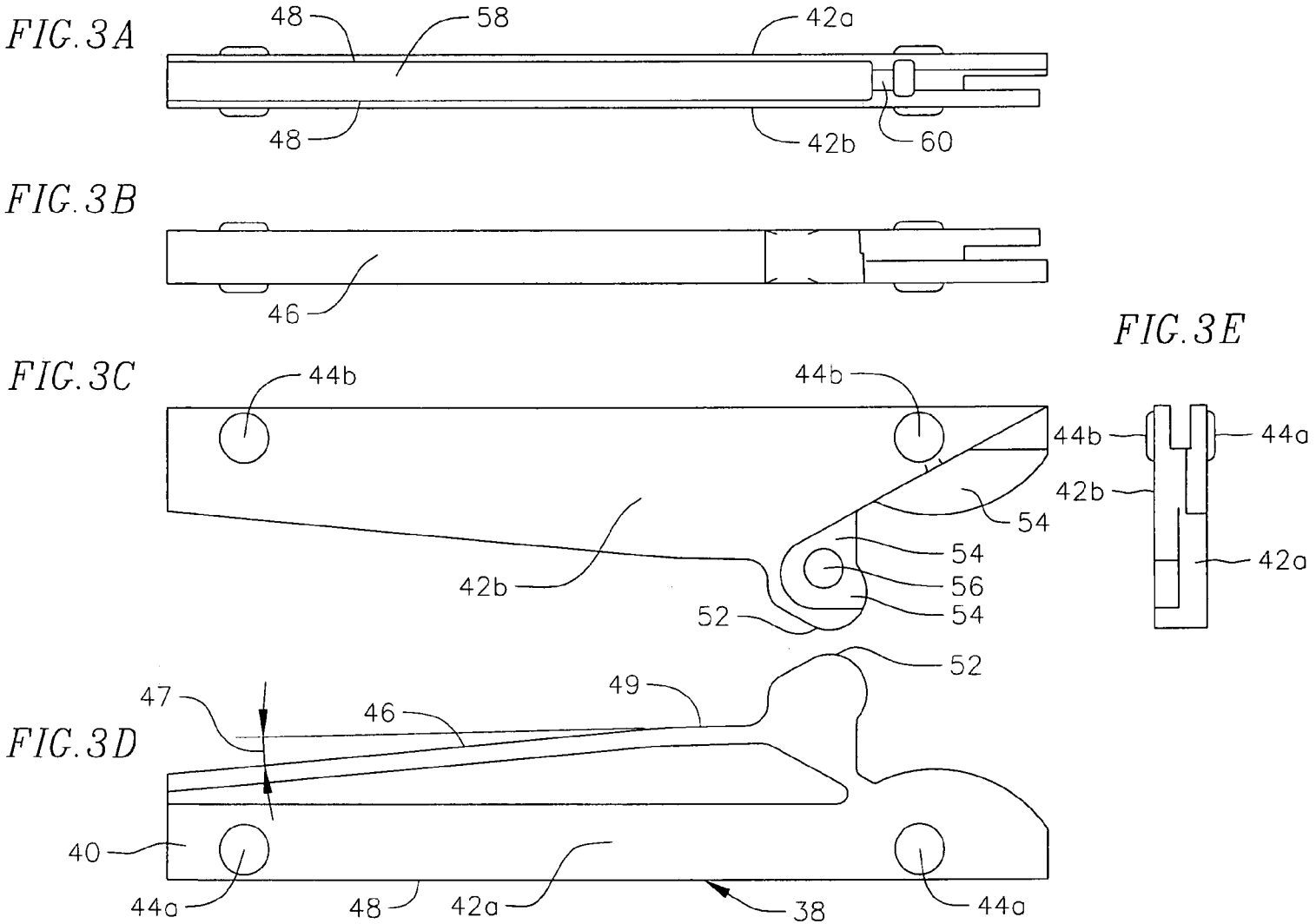
FIGS. 3A, 3B, 3C, 3D and 3E are top, bottom, side, side and end views, respectively, of an exemplary embodiment slider incorporated in an exemplary embodiment dampened movement mechanism of the present invention.

A slider 38, as for example shown in FIGS. 1 and 3 is mounted within the housing such that it is guided along the slider grooves 18*a*, 18*b*. The slider has a body 40 bounded by two spaced apart side surfaces 42*a* and 42*b*, respectively. One or more spaced apart projections 44*a* and 44*b* extend from each side surface, respectively. These projections are received within the slider grooves 18*a* and 18*b*, respectively for guiding the slider along the slider grooves. The slider body has an upper surface 46 and lower edges 48. In the shown exemplary embodiment, the lower edges are relatively flat. The upper surface 46 tapers (i.e., inclines) in a rearward direction such that the thickness of the body decreases in a rearward direction. In an exemplary embodiment, the upper surface tapers at an angle 47. In an exemplary embodiment, the angle 47 is about 5°. The angle of taper of the upper surface is reduced or completely alleviated in a forward portion 49 of the upper surface. An ear 52 extends above the upper surface of the body. A depression 54 is formed through surface 42*b* of the body and through the ear. An opening 56 is formed on the ear extending to the depression 54. The opening may or may not penetrate the entire thickness of the ear.

A channel 58 is defined between the two side surfaces 42*a*, 42*b* and between the lower edges 48 of the body 40. The width of the channel is stepped to a smaller width and then to a larger width defining a neck 60. In the exemplary embodiment shown in FIGS. 3A-3D the neck is formed at a front portion of the body. However, in other exemplary embodiments, the neck may be formed at various other locations along the body length.

A spring 62 (FIG. 1) is mounted in the channel 58 formed between the two side surfaces. In the shown exemplary embodiment, the spring 62 is a tension spring. At each end portion, the spring diameter is decreased and then again increased forming a spring neck 64. One spring neck 64 is received within the channel neck 60 while the other spring neck 64 is received in a notch 66 (FIGS. 1 and 2B) formed on a rearward end 68*a* of the housing portion 12*a*. The notch 66 and the channel neck 60 retain the spring necks 64 in place. In further exemplary embodiments, the spring may be coupled to other locations on the housing rearward of the slider. In other exemplary embodiments, the spring may be connected to the slider and the housing using other means. For example, the spring may be fastened to the slider and/or the housing using fasteners. In an alternate exemplary embodiment, a compression spring instead of a tension spring may used. In such case one end of the spring is coupled to the slider while the other end is coupled to the housing forward of the slider.

A dampener 70 is mounted within the dampener grooves 32*a*, 32*b* in the housing portions 12*a*, 12*b*, as for example shown in FIG. 1. In an exemplary embodiment the dampener is a cylindrical member having a piston with a dampener arm which in an exemplary embodiment is a piston arm 72 extending through a cylindrical body 74 of the dampener.

The dampener cylindrical body has a diameter greater than the diameter of the dampener arm and greater than the width of the link groove. In this regard, the dampener body is retained within the larger width main portion 32*a*, 32*b*, of the dampener groove. When mounted on the dampener groove, the dampener arm of the dampener extends into the link groove portion 34*a*, 34*b*. The dampener may be hydraulic and/or pneumatic and/or it may be spring loaded. When a compressive force is applied to the dampener arm, it is dampened as the piston tries to slide against the hydraulic, pneumatic and/or spring force. In other words, the dampener dampens loads applied to the dampening arm by resisting or slowing the linear retractable travel of the dampening arm when the arm is subjected to an axial compressive force. When the axial compressive force is removed, the dampener hydraulic, pneumatic or spring forces cause the dampener arm to extend to its original non-retracted position. An exemplary embodiment dampener is made under the name "Smove" by Salice, an Italian Corporation. Other types of dampeners may also be used.

Figure 4A:
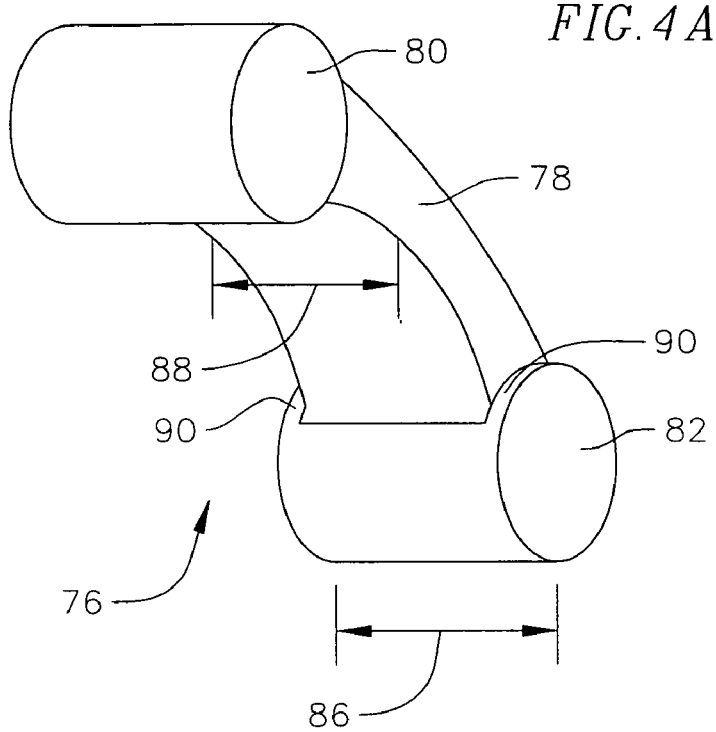
FIG. 4A is a perspective view of an exemplary embodiment link for incorporation in an exemplary embodiment dampened movement mechanism of the present invention.

A link 76, as for example shown in FIGS. 1 and 4A, is mounted in the link groove portions 34*a*, 34*b* of the dampener grooves 30*a*, 30*b*, formed on the housing portions 12*a*, 12*b*, respectively. In an exemplary embodiment as shown in FIGS. 1 and 4, the link has a curved body 78. A first rounded end portion 80 extends from one end of the body, and a second rounded end portion 82 extends from the other end of the body. In the exemplary embodiment, shown in FIGS. 1 and 4A, the width 86 of the end portions 80 and 82 is greater than the width 88 of the body 78 such that the end portions extend beyond opposite sides of the body defining projections 90. The projections are guided by the link grooves 34*a*, 34*b*. In the exemplary embodiment, the end portion 82 projections are guided within the first portions 35*a*, 35*b*, while the end portion 80 projections are guided within the second portions 37*a*, 37*b* of the link grooves.

Figure 4B:
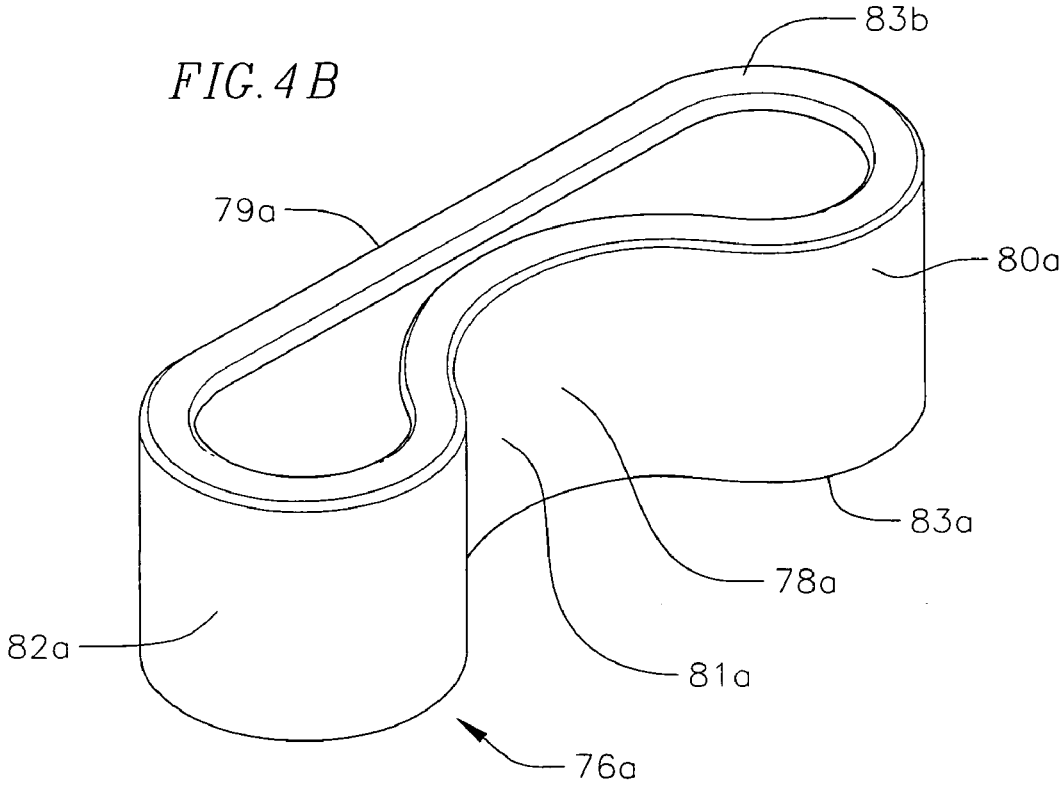
FIG. 4B is a perspective view of another exemplary embodiment link for incorporation in an exemplary embodiment dampened movement mechanism of the present invention.

Another exemplary embodiment link 76*a*, as shown in FIG. 4B, has a curved body 78*a*. A first rounded end portion 80*a* extends from one end of the body and a second rounded end portion 82*a* extends from the other end of the body. In this exemplary embodiment, the body has a relatively flat surface 79*a* opposite a concave surface 81*a* as for example shown in FIG. 4B. This exemplary embodiment link includes opposing peripheral end edges 83*a* and 83*b* for riding in link grooves 34*a* and 34*b*, respectively.

When mounted on the link grooves, the second end portion 82 of the link interfaces with the dampener arm 72 of the dampener and the first end portion 80 rides on the upper surface 46 of the slider. In this regard, as the slider slides rearward along the slider groove, the tapering or inclining upper surface of the slider causes the link to travel along the link groove and exert a force on the dampener arm which force is dampened by the dampener. The curved body 78 of the link has a reduced thickness in comparison to the end portions allowing the link to travel along the two portions of the link grooves, without interfering with the other housing structure.

A pivoting member 92 (FIGS. 1, 5A and 5B) is coupled to the slider 38. In the exemplary embodiment shown in FIGS. 1 and 5, the pivoting member includes a pin 94 extending transversely from one surface 96 thereof which is received in the opening 56 formed on the ear 52 of the slider. The pin 94 extends from an end portion 98 of the pivoting member which is received within the depression 54 formed on the ear of the slider. In the shown exemplary embodiment, the pivoting member includes a finger 96 which extends angularly in an upward and forward direction. A depression 99 is defined on a surface 100 of the pivoting member opposite the surface 96 from which extends the pin 94. The depression narrows in width in a direction towards the rear portion of the pivoting member and then slightly increases in width defining a neck portion 102 and a bulbous shaped rear portion 104. A first projection 106 extends transversely from the pivoting member proximate the forward end of the depression 99. A second projection 108 extends opposite the first projection 106. The second projection rides within the pivoting member groove 20*a* formed on housing portion 12*a*.

Figure 6A:
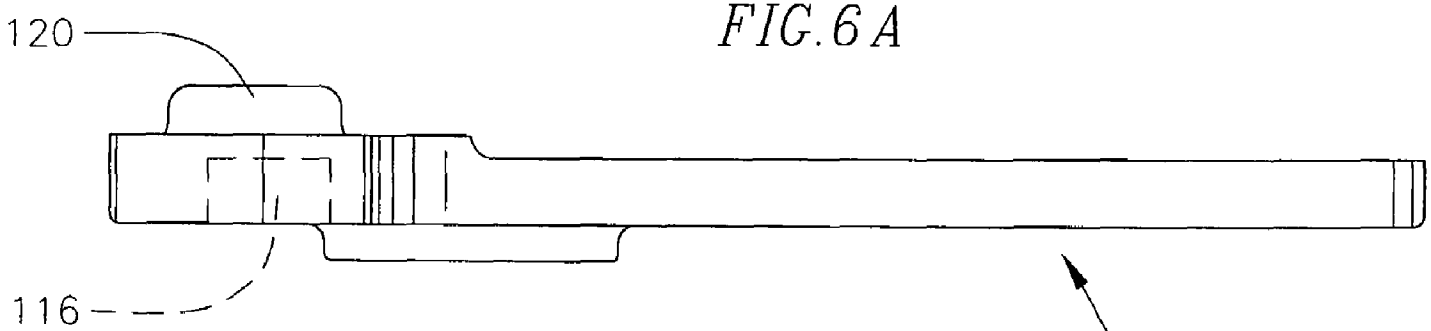
FIGS. 6A and 6B are bottom and side views of an exemplary embodiment reload arm for incorporating in an exemplary embodiment dampened movement mechanism of the present invention.
Figure 6B:
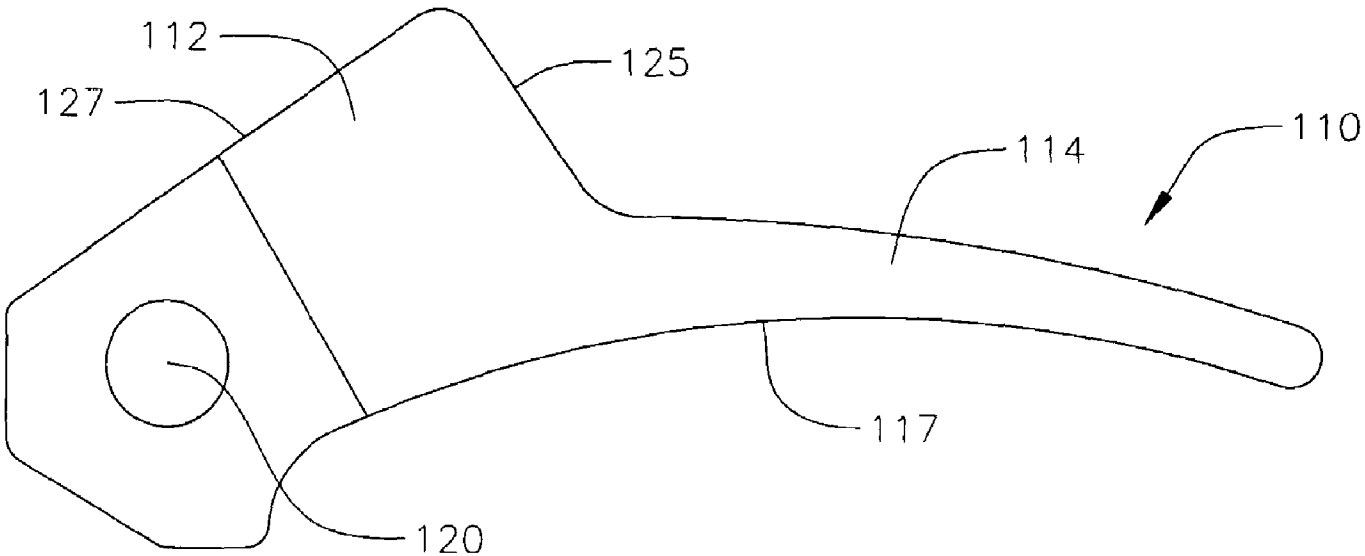

A reload arm 110 (FIGS. 1, 6A and 6B) is mounted within the depression 99 formed on the pivoting member. The reload arm has a body 112 from which extends a finger 114. The reload arm includes a depression 116 which receives the first projection 106 formed on the pivoting member. When mounted on the pivoting member, the finger 114 extending from the reload arm is received within the neck portion 102 and the bulbous shaped rear portion 104 of the depression. The edge 119 of the neck portion and the bulbous shaped rear portion of the depression 94 retain the rear end portion thereby limiting or preventing the vertical movement of the finger rear end portion.

A projection 120 extends transversely from the surface of the reload arm opposite the depression 116 which receives the first projection 106 formed on the pivoting member. The projection 120 is guided within the pivoting member groove 20*b* formed on housing portion 12*b*. When the reload arm is mounted on the pivoting member, they define an actuator which can pivot relative to the pin 94 and the second depression 56 formed on the slider member ear. A slot 121 is defined between a front edge 123 of the pivoting member finger 96 and a rear edge 125 of the reload arm body 112. The edges 123 and 125 extend upward and forward.

In an exemplary embodiment, the design of the reload arm allows it to flex when a load is imposed on the reload arm body 112. In the exemplary embodiment, the finger of the reload arm which is curved and the lower surface of the reload arm body 112 define a downward curve 117 such that when a load is imposed on the upper surface 127 of the body 112, the reload arm pivots about the pin 106 of the pivot member causing the curved finger to attempt to straighten as the edges 119 of the pivoting member restrain or limit the vertical movement of the rear end portion of the finger. As the curved finger straightens it travels further into the bulbous shaped region of the depression 99 formed on the pivoting member.

Figure 7:
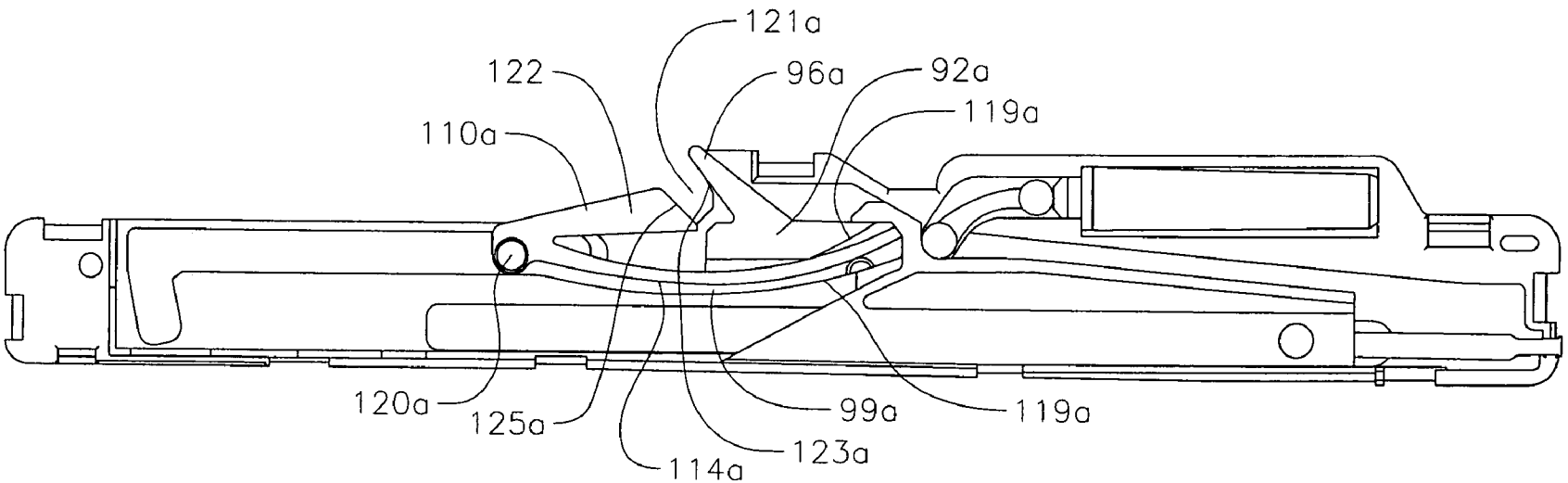
FIG. 7 is a top view of another exemplary embodiment dampened movement mechanism of the present invention with one housing portion removed.
Figure 8:
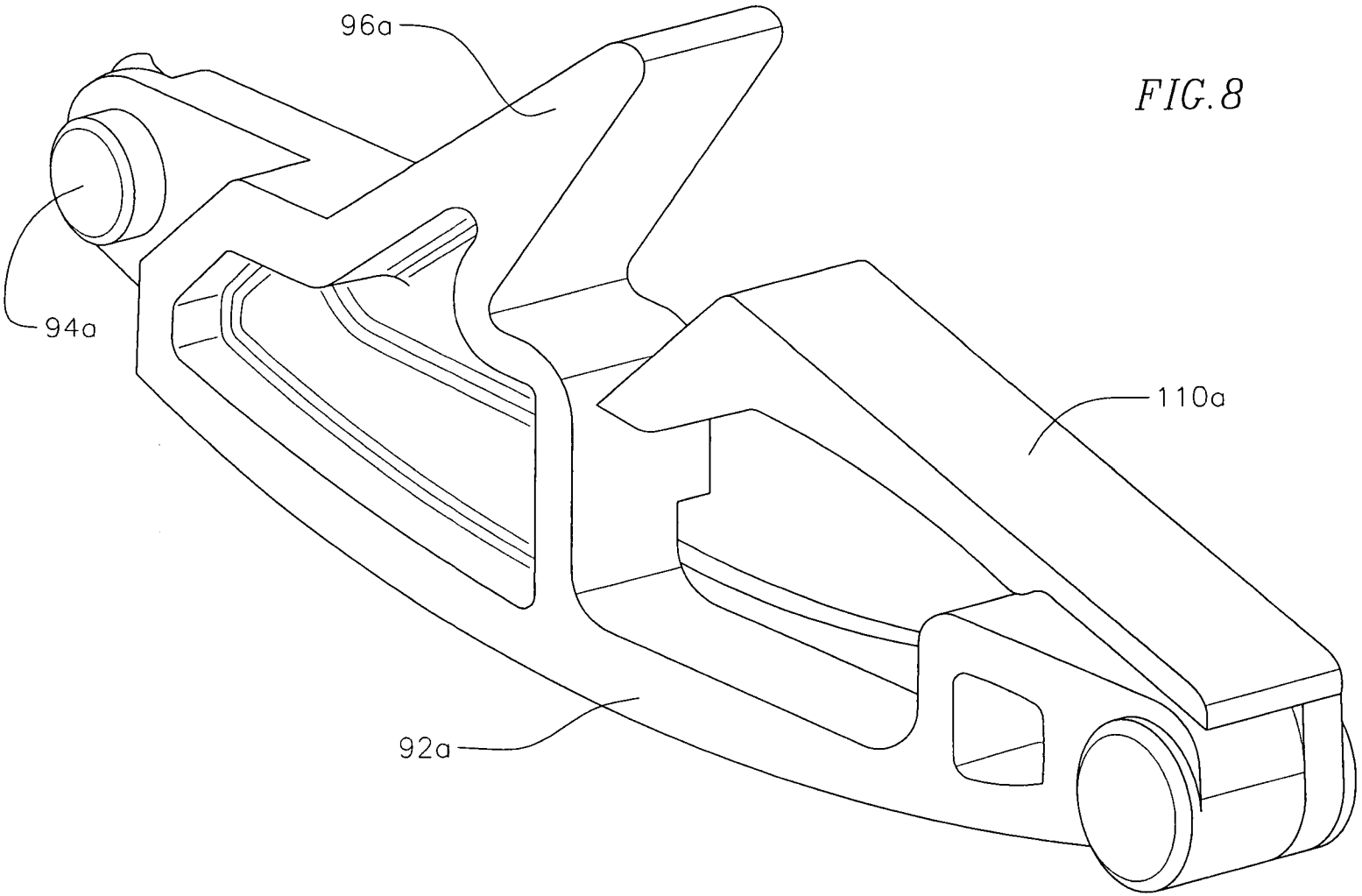
FIG. 8 is a perspective view of another exemplary embodiment pivoting member with reload arm for an exemplary embodiment dampened movement mechanism of the present invention.

In an alternate embodiment as shown in FIGS. 7 and 8, a pivoting member 92*a* may be coupled to the slider opening 56 formed on the slider ear via a pin 94*a*. This exemplary embodiment pivoting member has a finger 96*a* extending angularly in an upward and forward direction as for example shown in FIGS. 7 and 8. This exemplary embodiment pivoting member also includes a depression 99*a*. A reload arm 110*a* is pivotally coupled to the pivoting member via a pin and depression combination similar to pin 106 and depression 116 combination in the embodiment shown in FIGS. 1, 5 and 6.

A projection 120*a* extends from the reload arm 110*a* for riding within the pivoting member groove 20*b* on housing portion 12*b*. With this exemplary embodiment, the reload arm includes a curving finger 114*a* which is received in the depression 99*a* of the pivoting member. An upper finger 122 extends from a forward end of the reload arm in a rearward direction and is spaced apart from the curving finger 114*a*. The upper finger 122 can flex relative to the finger 114*a* when exposed to a downward force. A slot 121*a* is defined between the finger 96*a* of the pivoting member and the upper finger 122 of the reload arm. More specifically slot 121*a* is defined between edges 123*a* and 125*a* of the pivoting member and reload arm, respectively, wherein both edges 123*a* and 125*a* extend upward and forward. Edges 119*a* defined in the depression 99*a* of the pivoting member provide vertical support to a portion of the finger 114*a* of the reload arm. In this regard, the upward or downward travel of such portion of the finger is limited or prevented by the edges 119*a*.

In further alternate embodiments, the pivoting member with the reload arm may be formed integrally with a finger of the reload arm extending from the pivoting member such that the finger can flex or bend relative to the pivoting member and then resume its original position. In another exemplary embodiment, the reload arm may be spring loaded relative to the pivoting member using springs such as torsional springs. In this regard, the reload arm may just be a piece of material extending along the pivoting member and which can pivot in a first direction against the spring force and then pivot in a second direction opposite the first direction by the spring force.

Figure 5A:
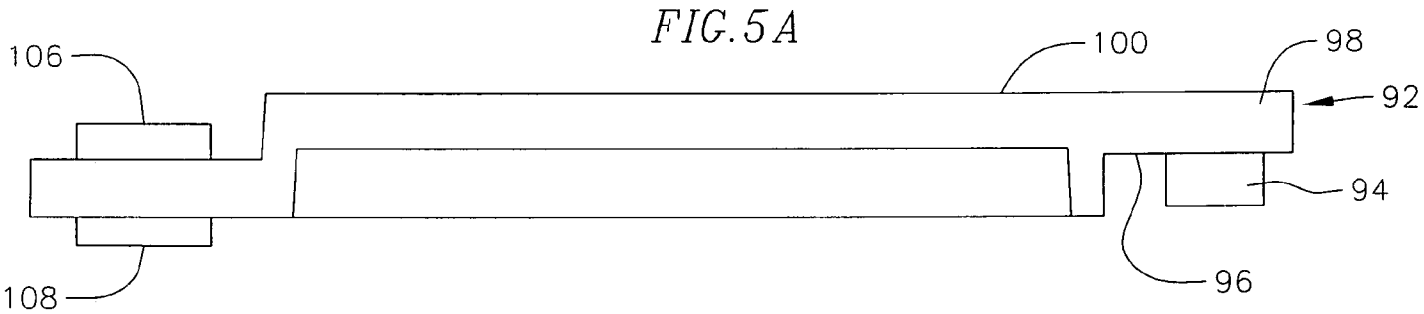
FIGS. 5A and 5B are bottom and side views of an exemplary embodiment pivoting member for incorporation in an exemplary embodiment dampened movement mechanism of the present invention.
Figure 5B:
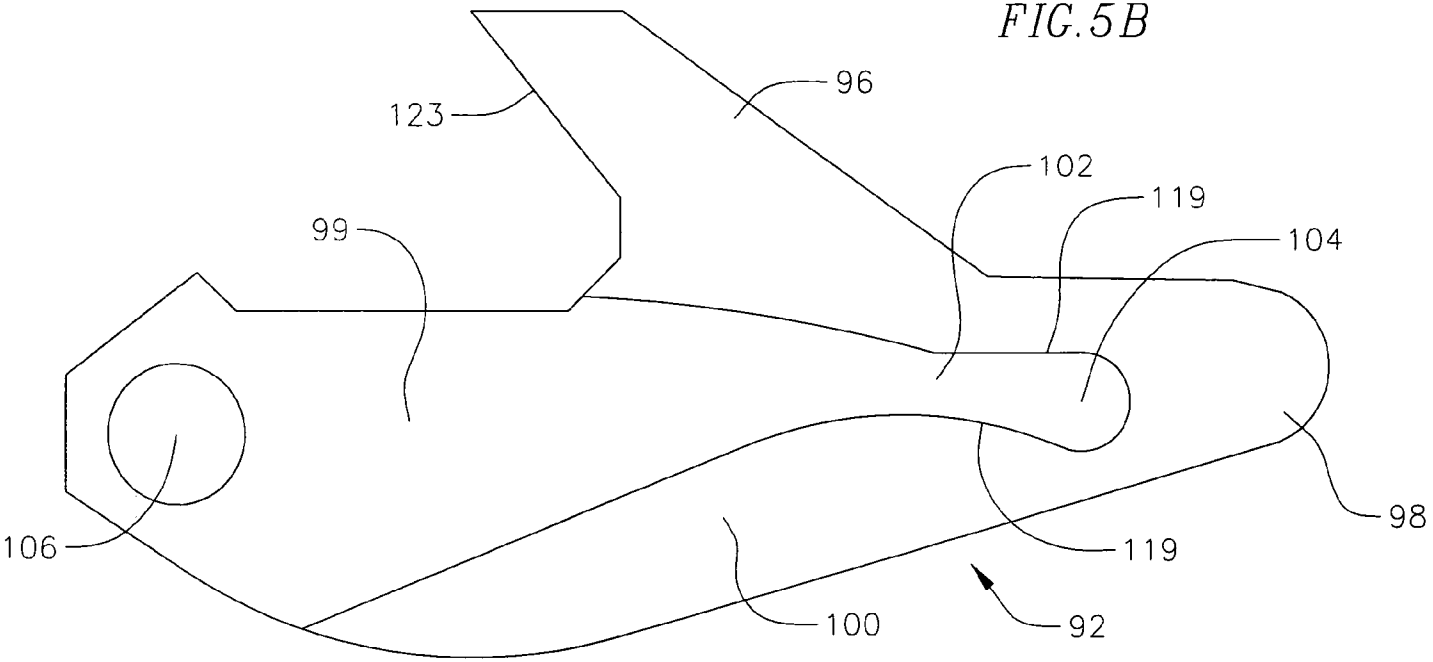
Figure 5C:
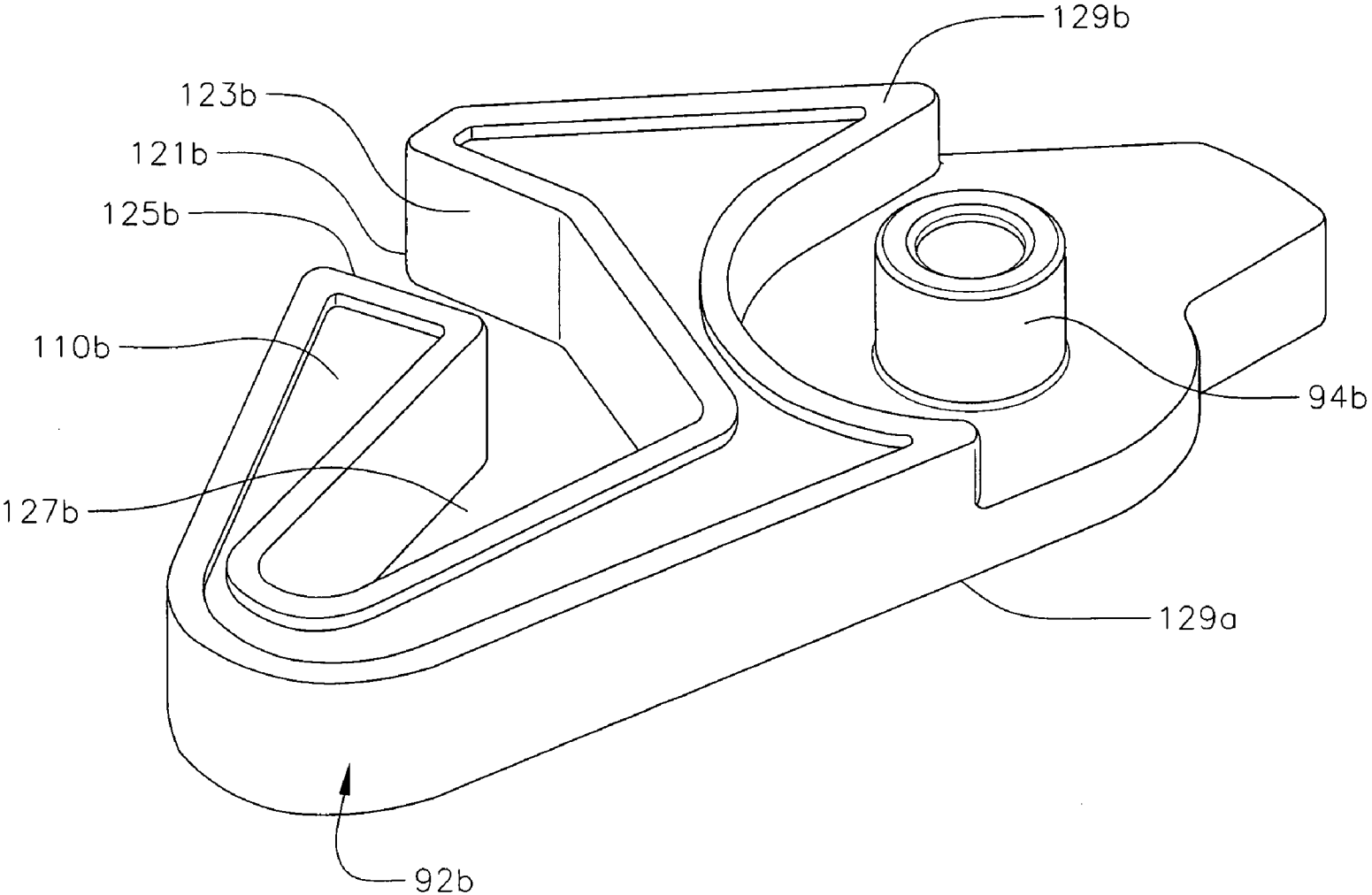
FIG. 5C is a perspective view of an exemplary embodiment actuator for incorporation in an exemplary embodiment dampened movement mechanism of the present invention.

In another exemplary embodiment, as for example shown in FIG. 5C, a separate reload arm is not used. With this exemplary embodiment, a pivoting member 92*b* defines the actuator. The pivoting member 92*b* has a slot 121*b*. A forward portion 110*b* of the pivoting member forms a front edge 125*b* of the slot. The forward portion 10*b* is flexible. With this exemplary embodiment, when the setter is received within the slot 121*b*, it is received within a portion of the slot 121*b* between the front edge 125*b* and a rear edge 123*b*. As can be seen from this exemplary embodiment, the forward portion 110*b* of the pivoting member is made flexible by being formed as an arm extending relative to the pivoting member. A space 127*b* is provided which allows the forward portion 110*b* to flex or compress relative to the pivoting member 92*b* closing such space 127*b*.

With either of the exemplary embodiment pivoting members, as shown in FIGS. 5A, 5B and 5C, a pin 94 or 94*a* extending from the pivoting member which pivotally couples the pivoting member to the slider may extend from either side of the pivoting member body. For example, in FIG. 5C the pin 94*a* extends from an opposite side of the pivoting member body than the pin 94 shown in FIG. 5A. The slider used with the pivoting member shown in FIGS. 5A and 5B or the pivoting member shown in FIG. 5C, should be designed to allow for coupling with the pin 94 or 94A, respectively, of such pivoting member. For example, a slider 38*a*, as for example, shown in FIG. 3F may be used with the pivoting member 92*b* shown in FIG. 5C. As can be seen from FIG. 3F, the slider has an opening 56*a* for penetration by the pin 94*b* to allow for pivotal coupling between the pivoting member and the slider. Projections 45*b* and 45*a* are formed on the slider body for being received in the slider grooves 18*a* and 18*b* of the housing portions 12*a* and 12*b*, respectively, for guiding the slider along the slider grooves.

When the first housing portion is coupled to the second housing portion, the slider is guided within the slider grooves and the pivoting member is guided within the pivoting member grooves formed on the housing portion. Similarly, the link is guided along the link grooves forced on the housing portions. The slider, link, pivoting member, and reload arm may be formed from various materials such as plastics, as for example acetates or polymers.

In alternate embodiments, the projection and groove combinations, or projection and depression combinations, where a projection sits in or is guided within in a groove or depression may be reversed. In other words, a part that has been described as having a projection may in an alternate embodiment be made to have a depression or a groove and a corresponding part that has been described as having a depression or groove may be made to have a projection.

Figure 9:
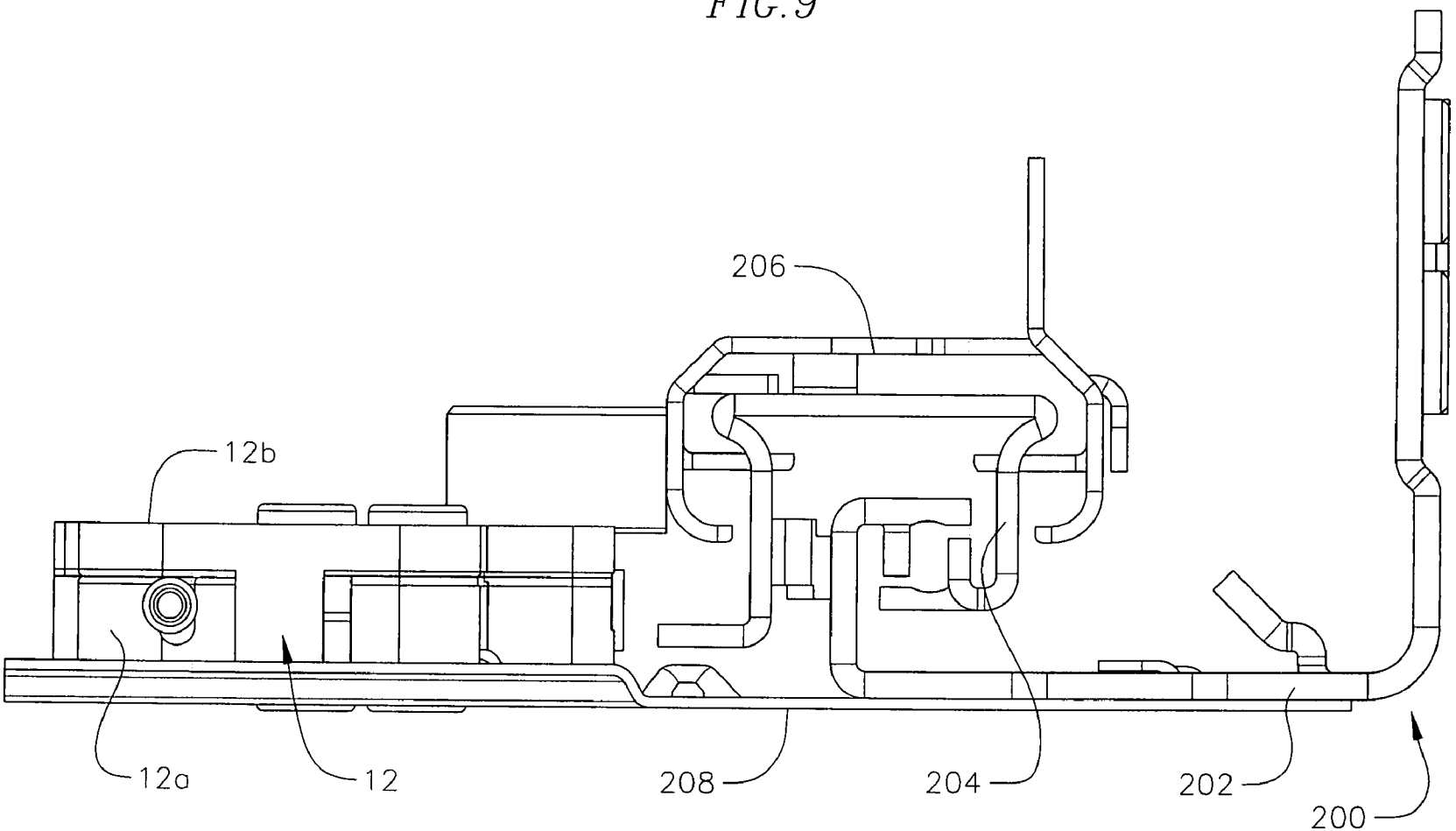
FIG. 9 is a rear end view of an exemplary embodiment self-moving under-mount slide with a mounted exemplary embodiment self-moving mechanism of the present invention.

In an exemplary embodiment, a dampened movement mechanism of the present invention is mounted on a under-mount slide 200 to serve as a self closing dampened mechanism to provide for a soft close of a drawer of a cabinet. An exemplary under-mount slide 200 is shown in cross-section in FIG. 9. A typical under-mount slide has a stationary member 202 which is mounted on a cabinet stationary structure (not shown). An intermediate slide member 204 is slideably coupled to the stationary member. An extendible slide member 206 is slideably coupled to the intermediate member and to a cabinet moving member such as a drawer (not shown). In another exemplary embodiment, the slide may only have a stationary member and an extendible member that is directly slideably coupled to the stationary member. The slide members are slideably coupled to each other using bearings (not shown). Typically, two slides are used to couple a drawer to the cabinet, one on each side of the drawer. The drawer is typically mounted on an upper surfaces of the extendible members. The exemplary dampened movement mechanism may be mounted on one or both slides. For convenience, a dampened movement mechanism mounted on one slide is only described herein.

In the shown exemplary embodiment, the exemplary dampened movement mechanism is mounted onto the stationary member using a bracket 208 which is mounted to an undersurface of the slide stationary member. The dampened movement mechanism housing portion 12*a* is rested against the bracket such that housing is spaced apart from the slide stationary member and is proximate the extendible slide member, as for example shown in FIG. 9. Lance tabs cut from the bracket or other known means may be used to retain the housing on the bracket. In another exemplary embodiments, the housing may be adhered to the bracket. In addition, when mounted on the bracket, the slot 121, 121*a* defined between the pivoting member and the reload arm, faces the slide extendible member 206.

Figure 10:
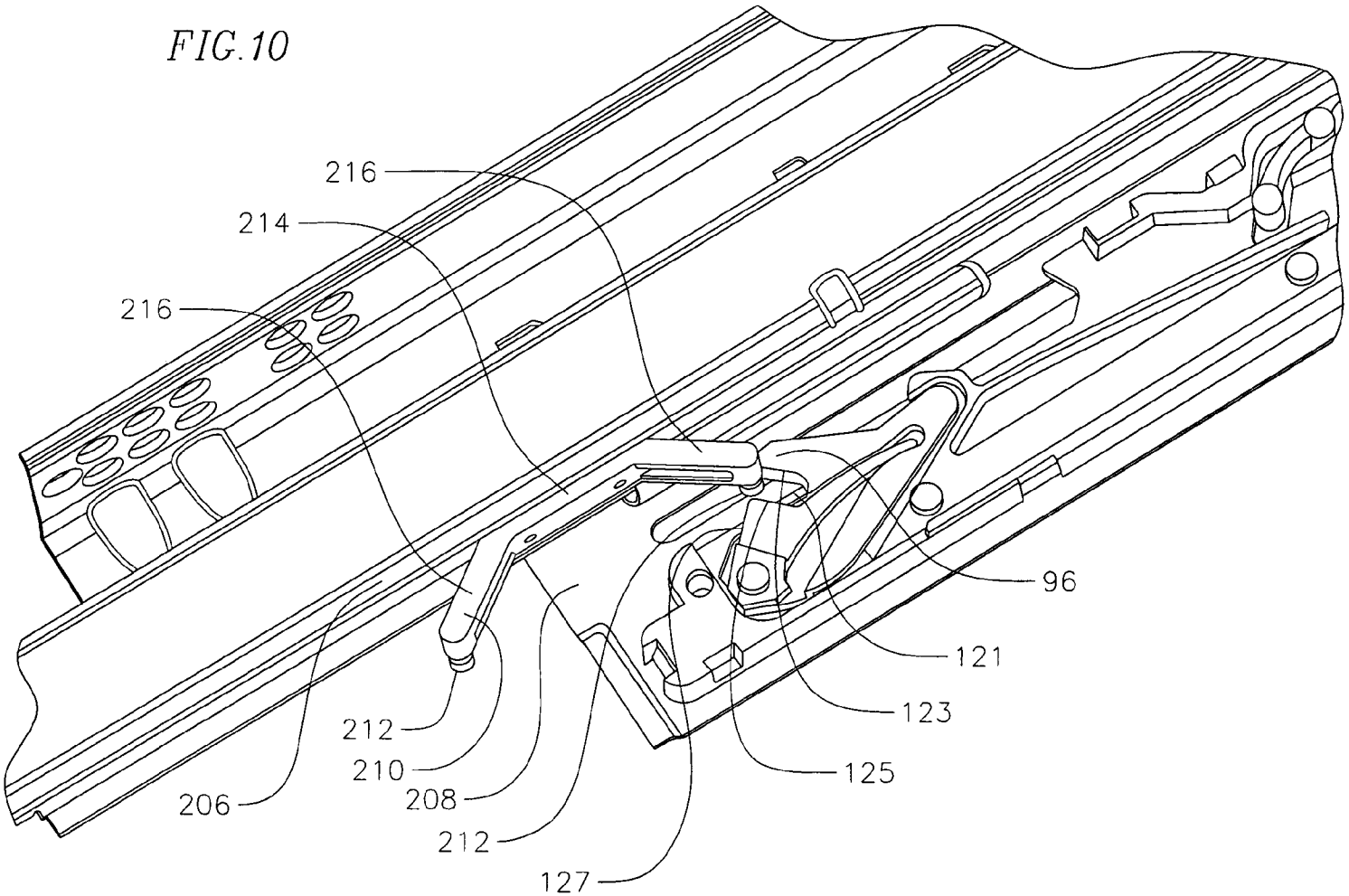
FIG. 10 is a perspective view of an exemplary embodiment dampened movement mechanism of the present invention, with a housing portion of the dampened movement mechanism removed, mounted on an exemplary embodiment self-moving under-mount slide via a bracket.

A setter 210 is coupled to the extendible member 206 as for example shown in FIG. 10. In an exemplary embodiment, the setter includes a pin 212 that is received within the slot 121, 121*a* defined between the pivoting member and the reload arm. In an exemplary embodiment, the setter comprises a body portion 214 and two arms 216 extending symmetrically from either end of the body. A pin 212 extends transversely from each arm. By using a setter with two arms and two pins, a single type of setter can be used with both left and right hand slides used to couple the drawer to the cabinet. In an alternate exemplary embodiment, the setter only includes one arm and one pin. In yet a further alternate exemplary embodiment, the setter may be a lanced tab that is lanced out of the slide extendible member such that it extends outward or it may be an arm coupled to the extendible member (not shown) which tab or arm is receivable within the slot 121, 121*a* formed between the pivoting member and the reload arm.

Since the exemplary embodiment dampened movement mechanism is mounted to act as a self closing dampened mechanism, the exemplary embodiment mechanism is mounted at a position along the stationary member such that when the drawer is in a fully closed position, the setter pin or arm that is receivable by the slot 121, 121*a* is positioned proximate or at the slot 121, 121*a* position when the pivoting member is at a rear end position of its travel along the pivoting member grooves as for example shown in FIG. 1.

For illustrative purposes, the operation of the dampened movement mechanism is described interacting with a setter having a setter pin. However, in other exemplary embodiments, the setter does not necessarily have to have a pin. Under normal operation when the drawer is open, the extendible slide is extended relative to the slide stationary member and the pivoting member second projection 108 and the reload arm projection 120 are in the second transverse portions 24*b* and 24*a*, respectively of the pivoting member grooves. When at that position, the slider 38 is at a forward travel position whereby the spring 62 is extended generating a force which pulls the projections 108 and 120 against the pivoting member grooves transverse portion rear edges 27*b* and 27*a*, respectively, thereby retaining the slider and the pivoting member is a forward "armed" position against the edges 27*b*, 27*a*.

As the drawer is closed, the extendible member retracts relative to the stationary member. When the pin of the setter reaches the slot 121, 121*a* defined between the pivoting member and the reload arm, it enters the slot and exerts a force on the finger 96 of the pivoting member via the edge 123 of the finger 96 (FIG. 10), causing the pivoting member to pivot about the pivoting member pin 94 and opening 56 formed on the slider and rotate as the projections 108 and 120 are guided along the transverse portions of the pivoting member grooves 24*b* and 24*a*, respectively. When that occurs, and when the projections 108 and 120 are received within the longitudinal portions 22*b* and 22*a*, respectively, of the pivoting member grooves, the force exerted by the spring, pulls on the slider which in turn pulls on the pivoting member, which in turn causes the reload arm rear edge 125 defining the slot 121, 121*a* to exert a force on the setter pin towards the rear of the slide, thereby causing the slide extendible member 206 and the drawer to move toward a closed position.

As the slider slides towards the rear end of the housing, the tapering upper surface 46 of the slider exerts an upward force on the link since the height of the portion of the slider upper surface interfacing with the link increases, gradually moving the link along the link grooves and causing the link to apply a force to the dampener arm of the dampener. This force is dampened by the dampener, thereby, dampening the sliding movement of the slider, and thus the sliding movement of the slide extendible member and the drawer. By using a curved link with a slider having a tapered upper surface for moving the link, a short throw or travel of the dampener arm provides for dampening of a much larger linear sliding movement of the slider and thus of the extendable slide member and the drawer. In an exemplary embodiment dampened movement mechanism, a 4/10 inch movement of the dampener arm provides for dampening of 2½ inches of linear sliding movement of the slider.

Consequently, as the slider and thus the slide extendible member and the drawer are moved to a closed position, the movement of the slide and thus the drawer is dampened and thus softened providing for a controlled closing. In an exemplary embodiment, where a forward upper portion 49 of the slider is not as tapered as the remaining upper surface 46 of the slider or is horizontal, as that portion approaches the link, the amount of dampening provided by the dampener is reduced as the amount of increase in force exerted by the linear movement of the slider on the link is reduced. The reduced dampening provides for a positive, less dampened, closing force by the spring on the extendible slide member and thus on the drawer when the slider and thus the extendable slide member and the drawer are close to the end of their travel. In other words, by reducing the dampening, a greater force is applied to slider and thus, to the extendible slide member during this last portion of travel to positively close the drawer.

When opening the drawer, the extendible slide member extends relative to the stationary member. As such, the setter pin, exerts a force on the reload arm rear edge 125 causing the slider projections 44*a*, 44*b* and the pivoting member and reload arm projections 108 and 120 to slide along the slider grooves and pivoting member grooves formed on the housing portions, respectively. As that occurs, the amount of force applied by the slider upper tapered surface against the link is reduced since the height of the slider portion upper surface exerting a force on the link is reduced, thereby allowing the dampener arm to extend outward.

As the drawer continues to be pulled open, the setter pin continues to exert a force on the reload arm rear edge 125 until the projection 108 of the pivoting member and the projection 120 of the reload arm reach the transverse portions 24*b* and 24*a*, respectively of the pivoting member grooves formed on the housing portions. When that occurs and as the extendible slide member continues to extend, the setter pin attempt to ride on the upward and forward extending, i.e., tapering, rear edge 125, 125*a* of the reload arm, thereby exerting a force on the rear edge 125, 125*a* of the reload arm causing the pivoting member to pivot about the pivoting member pin 94 and opening 56 formed on the slider ear and the projections 108 and 120 to engage the rear edges 27*b*, 27*a*, respectively of transverse portions of the pivoting member grooves formed on the housing portions. These rear edges retain the pivoting member and reload arm in an "armed" position as the extended spring applies a force on the slider which pulls the slider and thus the pivoting member and the reload arm and their projections 108 and 120 against the rear edges of the pivoting member grooves. As the drawer is further withdrawn, the setter pin withdraws from the slot 121, 121*a* defined by the pivoting member and the reload arm.

If the mechanism is accidentally "disarmed", i.e., the pivoting member with reload arm and the slider slide to a rearward position of the housing without the setter pin being in the slot 121, 121*a* defined between the pivoting member and reload arm, the mechanism can be easily "rearmed." This can be accomplished by closing the drawer. As the drawer is closing and the extendible slide member moves rearward, the setter pin will engage the reload arm forward edge 125, 125*a* causing the reload arm to flex (i.e., compress). As the extendable slide member is further retracted, the setter pin moves past the flexed reload arm into the slot 121, 121*a* defined between the reload arm and the pivoting member allowing for reengagement of the setter pin and the actuator. If the drawer is now opened the mechanism will rearm. In the exemplary embodiments where the reload arm is not used, as for example, when using a pivoting member 92*b* as shown in FIG. 5C, the setter pin will engage the forward portion 110*b* of the actuator member causing the forward portion to flex (i.e., compress) to allow for reengagement of the setter pin with the actuator.

The amount of dampening provided by the exemplary self-moving mechanisms is also a function of the taper of the upper surface 46 of the slider. If the taper angle 47 is increased a greater amount of dampening will be provided. Similarly, if the taper angle 47 is decreased a lesser amount of dampening is provided. In this regard, the amount of dampening to be provided once a dampener is selected can be tailored by selecting a slider having an appropriate upper surface tapering angle 47. Moreover, the amount of dampening provided may also be controlled by varying the shape and size of the link and/or the angle 36*a*, 36*b* between the groove main portion and the link portion of the dampener groove.

Any exemplary embodiment dampened movement mechanism may also be used as a self opening mechanism. This may be accomplished by reversing the described mounting of the mechanism on a slide.

In alternate exemplary embodiments, the spring may be coupled to the slider at one end and may be connected to the slide member on which the mechanism is mounted, instead of the self-moving mechanism housing, at the other end. In yet a further exemplary embodiment, instead of depressions or grooves formed on the housing, the housing may be formed with specific compartments which have geometries for guiding the movement of the parts, as for example the pivoting member, the reload arm, the slider or the link, which they house. In other words, the housing geometry itself may serve to guide the movement of the various parts of the mechanism.

Figure 2E:
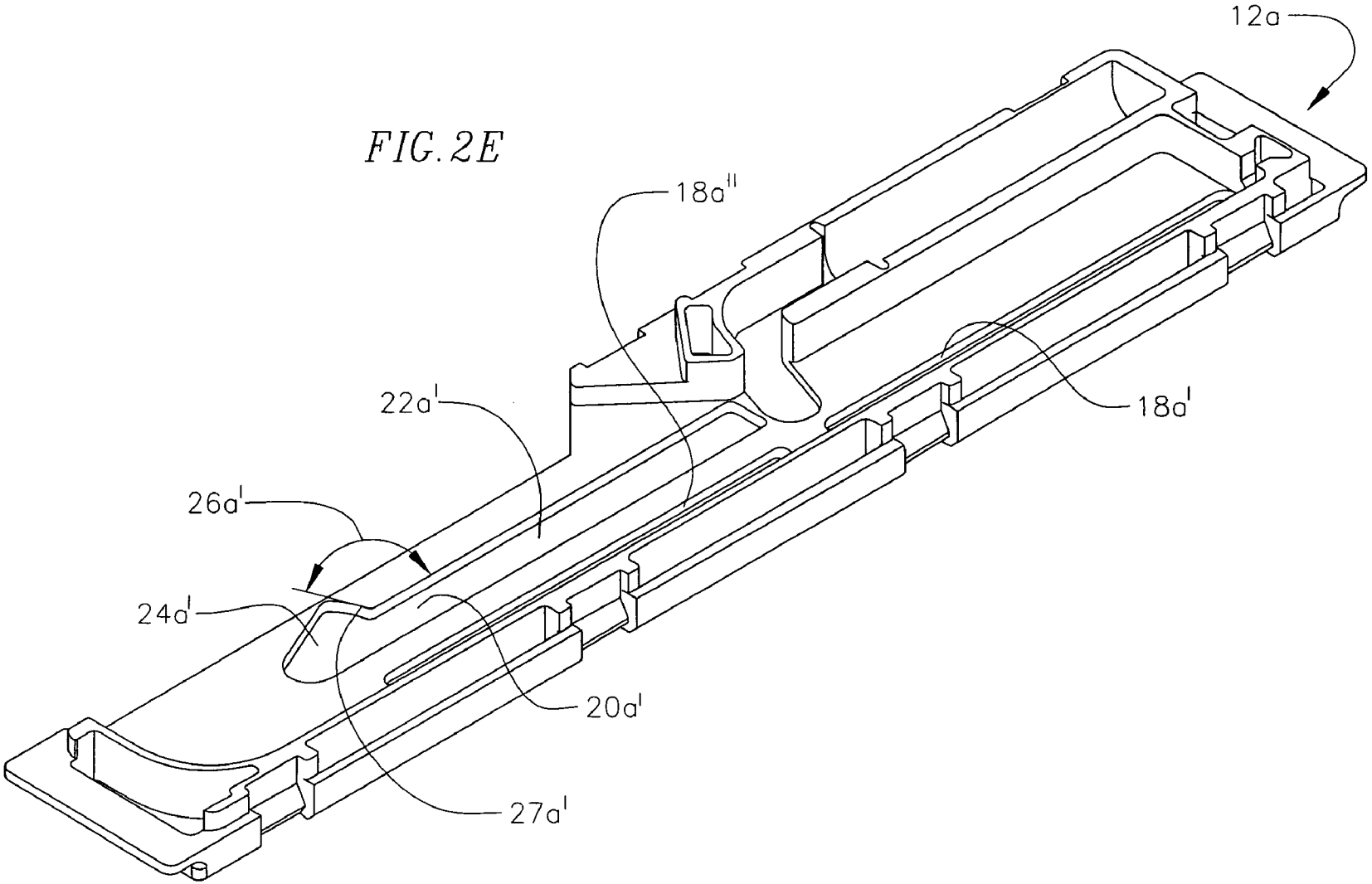
FIG. 2E is a perspective view of another exemplary embodiment housing portion of an exemplary embodiment dampened movement mechanism of the present invention.

In other exemplary embodiments, instead of a single groove multiple grooves may be formed. For example instead of a single slider groove 18*a*, two slider grooves 18*a*' and 18*a*" may be formed as for example shown in FIG. 2E for guiding the slider. In this regard, one of the slider projections, as for example slider projection 45*a* shown in FIG. 3F, will be received in groove 18*a*' and the other of the slider projections 45*a* will be received in groove 18*a*". Moreover, a second transverse portion 24*a*' of a pivoting member groove 20*a*' as for example shown in FIG. 2E may define a rear edge 27*a*' that is at an angle 26*a*' relative to the longitudinal portion 22*a*' of the pivoting member groove that is greater than 90° and less than 180°. In yet further exemplary embodiments, the dampened movement mechanism of the present invention may be mounted on a non-stationary member of a slide, as for example an intermediate slide member, for self-moving an extendible slide member slideably coupled to the non-stationary member.

Figure 3F:
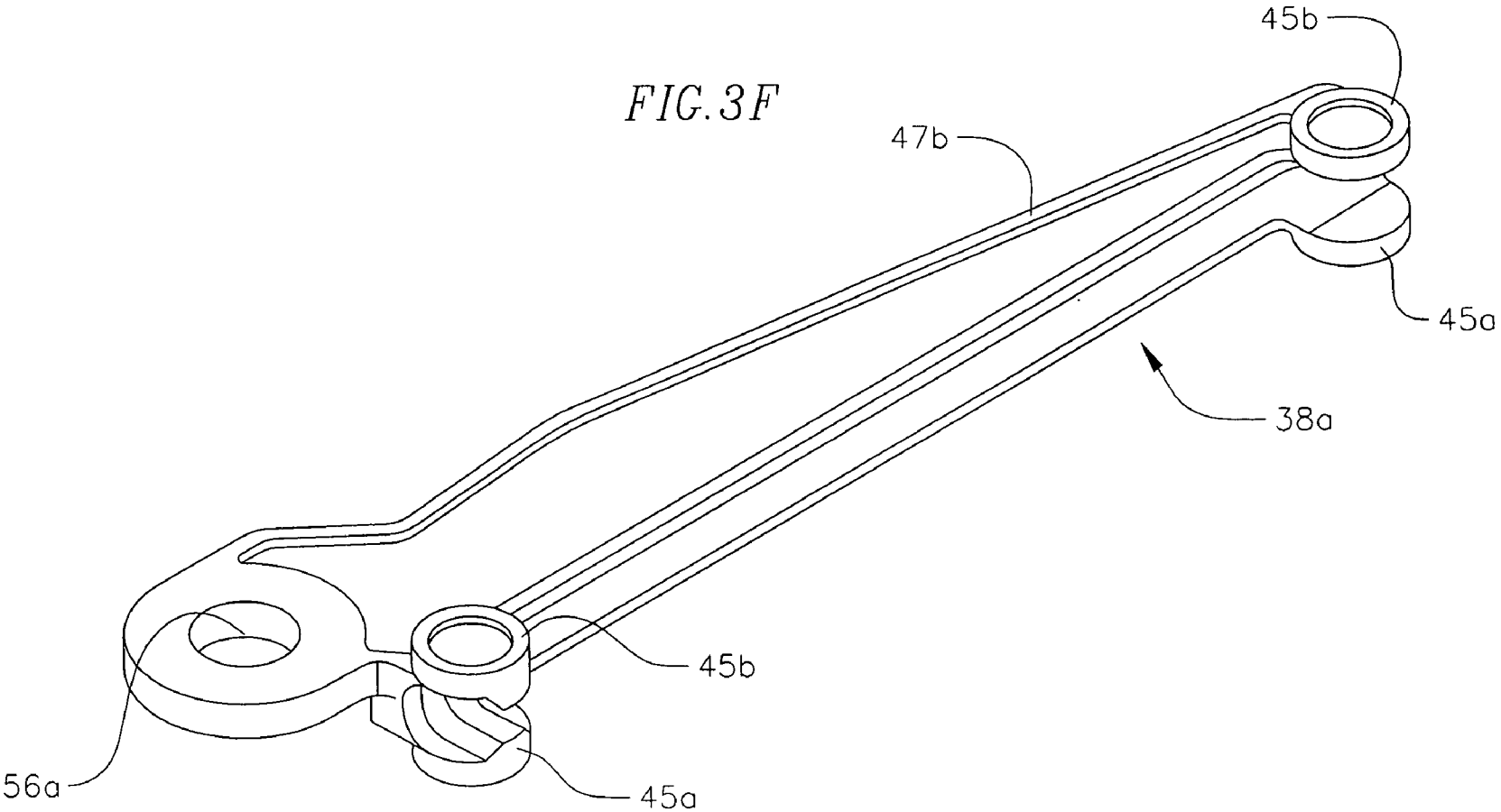
FIG. 3F is a perspective view of another exemplary embodiment slider for incorporation in an exemplary embodiment dampened movement mechanism of the present invention.

It should be noted that in other exemplary embodiments, the components, as for example, the slider 38*a* shown in FIG. 3F, or the link 76*a* shown in FIG. 4B, or the actuator 92*b* shown in FIG. 5C, are formed with peripheral edge surfaces or lips such as lip 47*b* shown in FIG. 3F, or lip 83*b* shown in FIG. 4B, or lip 129*b* shown in FIG. 5C for engaging corresponding grooves within the housing portion 12*b*. In this regard, a smaller surface of each component, i.e., the lip, makes contact with the housing grooves reducing the friction when such components slide within such grooves. Such lips may be used instead of projections or pins. For example, the actuator 92*b* does not have a projection for engaging the rear edge 27*a* in the pivoting member groove, but rather uses the lip 129*a* for engaging such rear edge 27*a* for being retained in an armed position.

In yet further exemplary embodiments, all the aforementioned exemplary embodiments may be formed with projections instead of grooves and grooves instead of projections. In other words, where a projection is called for in a first part to mate with a groove in a second part, instead of the projection, the first part may be formed with a groove and instead of the groove, the second part may be formed with a projection such that the projection of the second part mates with the groove of the first part.

The preceding description has been presented with reference to exemplary embodiments of the invention. Persons skilled in the art and technology to which this invention pertains will appreciate that alterations and changes in the described structures and methods of operation can be practiced without meaningfully departing from the principal, spirit and scope of this invention. Accordingly, the foregoing description should not be read as pertaining only to the precise structures and methods described and shown in the accompanying drawings.

The invention claimed is:

1. A self-moving slide comprising:

a first slide member;

a second slide member slideably coupled to the first slide member wherein the first slide member slides relative to the second slide member; and a self-moving mechanism coupled to the second slide member, the self-moving mechanism comprising, a housing, a slider sliding along the housing, an actuator pivotably coupled to the slider and sliding along the housing, said actuator being coupleable with the first slide member for moving the first slide member, a dampener dampening the movement of the slider, and a link coupling the dampener to the slider.

2. The self-moving slide as recited in claim 1 further comprising a spring coupled to the slider and the housing.

3. The self-moving slide as recited in claim 2 wherein the slider and actuator slide together along the housing between a first location and a second location.

4. The self-moving slide as recited in claim 3 wherein the spring exerts a force for moving the slider to the first location.

5. The self-moving slide as recited in claim 4 wherein when in the first location, the actuator is in a first position and when in the second location, the actuator can pivot to a second position.

6. The self-moving slide as recited in claim 5 wherein the dampener dampens the movement of the slider only when moving towards the first location.

7. The self-moving slide as recited in claim 6 wherein the slider comprises a inclining surface, wherein the link rides on the inclining surface as the slider slides towards the first location and exerts a force against the dampener.

8. The self-moving slide as recited in claim 7 wherein the dampener comprises a piston sliding within a body against a dampening force, and an arm extending from the piston, wherein the link exerts a force against the arm moving said arm against said dampening force.

9. The self-moving slide as recited in claim 6 further comprising a setter extending from the first slide member, wherein the actuator comprises a slot and wherein the setter is received in said slot coupling the first slide member to the actuator.

10. The self-moving slide as recited in claim 9 wherein the actuator comprises a pivoting member and a reload arm coupled to the pivoting member, and wherein the pivoting member is pivotably coupled to the slider pivotably coupling the slider to the actuator.

11. The self-moving slide as recited in claim 10 wherein the actuator comprises a first edge opposite a second edge, wherein the slot is defined between the first edge and the second edge, and wherein the first edge is formed on the reload arm and the second edge is formed on the pivoting member.

12. The self-moving slide as recited in claim 11 wherein as the first slide member extends relative to the second slide member, the setter causes the slider to move to the second location and the actuator to pivot to the second position, wherein when the actuator is in the second position, the setter decouples from the actuator as the first slide member is further extended.

13. The self-moving slide as recited in claim 12 wherein when the actuator is in the second position it is urged against a portion of the housing by the spring force, said actuator being retained in said second position by said portion of the housing.

14. The self-moving slide as recited in claim 12 wherein when retracting the first slide member relative to the second slide member, the setter couples with the actuator which is in the second position and causes the actuator to pivot to the first position, wherein when in the second position the spring force causes the actuator with the slider to slide to the first location thereby causing the setter and first slide member to slide to the first position.

15. The self-moving slide as recited in claim 12 wherein the housing comprises a first groove and a second groove, the second groove having a first portion and a second portion extending transversely from the first portion, wherein the slider comprises a projection, said slider projection guiding the slider along the first groove and wherein the actuator comprises a projection, said actuator projection guiding the actuator along the second groove, wherein when the actuator is in the second position, the actuator projection is in the second portion of the second groove and is urged against the second portion of the second groove by the spring force retaining the actuator against said second portion of the second groove.

16. The self-moving slide as recited in claim 15 wherein the reload arm is pushed by the setter and flexes when the slider is in the second location and the first slide member is retracted relative to the second slide member to allow setter to be received within the actuator slot.

17. The self-moving slide as recited in claim 15 wherein the housing comprises a first portion opposite a second portion, wherein the first and second grooves are formed on the first housing portion, wherein a third groove is formed on the second housing portion and wherein a fourth groove is formed on the second housing portion having a first portion and a second portion extending transversely from the fourth groove first portion, wherein the third groove mirrors the first groove and wherein the fourth groove mirrors the second groove, wherein the slider comprises a second projection guiding the actuator along the third groove and wherein the reload arm comprises a projection guiding the actuator along the fourth groove.

18. The self-moving slide as recited in claim 9 wherein the actuator comprises a portion that compresses when pushed by the setter when the slider is in the second location and the first slide member is retracted relative to the second slide member to allow setter to be received within the actuator slot.

19. The self-moving slide as recited in claim 18 wherein said actuator comprises a pivoting member pivotably coupled to the slider, and wherein said actuator portion is a reload arm coupled to pivoting member, wherein said reload arm compresses by flexing when pushed by the setter.

20. The self-moving slide as recited in claim 5 wherein the housing comprises a first groove and a second groove, the second groove having a first portion and a second portion extending transversely from the first portion, wherein the slider comprises a projection, said slider projection guiding the slider along the first groove and wherein the actuator comprises a projection, said actuator projection guiding the actuator along the second groove, wherein when the actuator is in the second position, the actuator projection is in the second portion of the second groove and is urged against the second portion of the second groove by the spring force retaining the actuator against said second portion of the second groove.

21. The self-moving slide as recited in claim 1 wherein the slider comprises a inclining surface, wherein the link rides on the inclining surface as the slider slides toward the first location exerting a force against the dampener.

22. The self-moving slide as recited in claim 1 further comprising a setter extending from the first slide member, wherein the actuator comprises a slot and wherein the setter is received in said slot coupling the first slide member to the actuator.

23. The self-moving slide as recited in claim 22 wherein the setter is separate from the first slide member and is coupled to the first slide member.

24. The self-moving slide as recited in claim 1, wherein the actuator comprises a compressible portion capable of being compressed by the first slide member.

25. The self-moving slide as recited in claim 24 wherein the actuator comprises a slot adjacent said compressible portion, wherein said first slide member comprises a portion received within said slot for coupling the first slide member with the actuator.

26. A self-moving slide comprising:

a first slide member;

a second slide member slideably coupled to the first slide member wherein the first slide member slides relative to the second slide member; and a self-moving mechanism coupled to the second slide member, the self-moving mechanism comprising, a housing, a slider sliding along the housing, an actuator pivotably coupled to the slider and sliding along the housing, said actuator being coupleable with the first slide member for moving the first slide member, a dampener dampening the movement of the slider, a spring coupled to the slider and the housing, wherein the slider and actuator slide together along the housing between a first location and a second location, wherein the spring exerts a force for moving the slider to the first location, wherein when in the first location, the actuator is in a first position and when in the second location, the actuator can pivot to a second position, wherein the housing comprises a first groove and a second groove, the second groove having a first portion and a second portion extending transversely from the first portion, wherein the slider comprises a projection, said slider projection guiding the slider along the first groove and wherein the actuator comprises a projection, said actuator projection guiding the actuator along the second groove, wherein when the actuator is in the second position, the actuator projection is in the second portion of the second groove and is urged against the second portion of the second groove by the spring force retaining the actuator against said second portion of the second groove.

27. A self-moving slide comprising:

a first slide member;

a second slide member slideably coupled to the first slide member wherein the first slide member slides relative to the second slide member; and a self-moving mechanism coupled to the second slide member, the self-moving mechanism comprising, a housing, a slider sliding along the housing, wherein said slider comprises an inclining surface, an actuator pivotably coupled to the slider and sliding along the housing, said actuator being coupleable with the first slide member for moving the first slide member, and a dampener being acted upon by said slider inclining surface for dampening the movement of the slider.

28. A self-moving slide comprising:

a first slide member;

a second slide member slideably coupled to the first slide member wherein the first slide member slides relative to the second slide member; and a self-moving mechanism coupled to the second slide member, the self moving mechanism comprising, a sliding member slideable relative to the second slide member, said sliding member being coupleable with the first slide member for moving the first slide member, a dampener dampening the movement of the sliding member, and a link coupling the dampener to the sliding member, wherein said entire sliding member is translationally slideable relative to the link.

29. A self-moving slide comprising:

a first slide member;

a second slide member slideably coupled to the first slide member wherein the first slide member slides relative to the second slide member; and a self-moving mechanism coupled to the second slide member, the self moving mechanism comprising, a sliding member slideable relative to the second slide member, wherein said sliding member comprises an inclining surface, and wherein said sliding member is coupleable with the first slide member for moving the first slide member, and a dampener being acted upon by said sliding member inclining surface for dampening the movement of the sliding member, wherein said inclining surface is slideable relative to the dampener.

30. The self moving slide as recited in claim 29 wherein the sliding member is translationally slideable relative to the dampener.

* * * * *

UNITED STATES PATENT AND TRADEMARK OFFICE

CERTIFICATE OF CORRECTION

PATENT NO. : 7,537,296 B2
APPLICATION NO. : 11/266870
DATED : May 26, 2009
INVENTOR(S) : Ricardo A. Leon et al.

It is certified that error appears in the above-identified patent and that said Letters Patent is hereby corrected as shown below:

| | |
|---|---|
| Column 14, Claim 7, line 9 | Delete "a" Insert -- an -- |
| Column 15, Claim 18, line 20 | Insert -- the -- before "setter" |
| Column 15, Claim 21, line 40 | Delete "A" Insert -- an -- |
| Column 16, Claim 28, line 48 | Delete "self moving" Insert -- self-moving -- |
| Column 15, Claim 29, line 64 | Delete "self moving" Insert -- self-moving -- |

Signed and Sealed this

Twenty-sixth Day of October, 2010

David J. Kappos

David J. Kappos
*Director of the United States Patent and Trademark Office*